US012678006B2

(12) United States Patent
Schnitzer et al.

(10) Patent No.: US 12,678,006 B2
(45) Date of Patent: Jul. 14, 2026

(54) METHOD FOR AUTONOMOUS PROCESSING OF FLOOR SURFACES

(71) Applicant: BSH Hausgeräte GmbH, Munich (DE)

(72) Inventors: Frank Schnitzer, Bad Neustadt (DE); Dominik Schreiner, Kalbach (DE); Julius Geis, Burkardroth (DE)

(73) Assignee: BSH Hausgeräte GmbH, Munich (DE)

( * ) Notice: Subject to any disclaimer, the term of this patent is extended or adjusted under 35 U.S.C. 154(b) by 220 days.

(21) Appl. No.: 18/259,627

(22) PCT Filed: Jan. 12, 2022

(86) PCT No.: PCT/EP2022/050514
§ 371 (c)(1),
(2) Date: Jun. 28, 2023

(87) PCT Pub. No.: WO2022/152736
PCT Pub. Date: Jul. 21, 2022

(65) Prior Publication Data

US 2024/0057835 A1 Feb. 22, 2024

(30) Foreign Application Priority Data

Jan. 18, 2021 (DE) ..... 10 2021 200 401.6

(51) Int. Cl.
*A47L 11/40* (2006.01)
*A47L 9/28* (2006.01)

(52) U.S. Cl.
CPC ..... *A47L 11/4011* (2013.01); *A47L 9/2857* (2013.01); *A47L 11/4061* (2013.01); *A47L 2201/04* (2013.01)

(58) Field of Classification Search
CPC .. A47L 11/4011; A47L 11/4061; A47L 11/40; A47L 11/4036; A47L 9/2857;
(Continued)

(56) References Cited

U.S. PATENT DOCUMENTS 6,917,854 B2 * 7/2005 Bayer ..... B25J 5/007
9,827,678 B1 * 11/2017 Gilbertson ..... A47L 11/4055
(Continued)

FOREIGN PATENT DOCUMENTS

DE 102004016345 A1 10/2005
DE 102016124901 A1 6/2018
(Continued)

OTHER PUBLICATIONS

Bahl et al., "CuBi: Room Decluttering Robot", Dec. 2019, Retrieved from the internet <url:https://mrsdprojects.ri.cmu.edu/2018teamd/wp-content/uploads/sites/34/2019/12/TeamD_FinalReport-10.pdf> (Year: 2019).*

*Primary Examiner* — Ellis B. Ramirez
(74) *Attorney, Agent, or Firm* — Laurence A. Greenberg; Werner H. Stemer; Ralph E. Locher

(57) ABSTRACT

A method for autonomous processing of floor surfaces by a mobile, self-driving device, in particular a floor cleaning device such as a vacuum and/or sweeping and/or mopping robot. The method includes: the mobile, self-driving device carrying out an exploration travel in a proposed floor processing region, detecting obstacles and/or objects located on the floor by a detection device, classifying the obstacles and/or objects as movable or not movable, and transporting the obstacles and/or objects classified as movable to at least one collection point. The collection point is cleaned before obstacles and/or objects classified as movable are transported to the collection point.

12 Claims, 1 Drawing Sheet

(58) Field of Classification Search
CPC ..... A47L 9/2826; A47L 2201/04; A47L 2201/06; A47L 7/00; A47L 7/009
USPC ..... 700/258, 253; 701/23, 28; 134/45, 56 R, 134/57 R, 18, 21; 901/1; 318/568.12
See application file for complete search history.

(56) References Cited

U.S. PATENT DOCUMENTS

| | | | | |
|---|---|---|---|---|
| 10,289,111 | B1 * | 5/2019 | Romano | G05D 1/0246 |
| 2014/0124004 | A1 * | 5/2014 | Rosenstein | G06T 7/00 |
| 2017/0023947 | A1 | 1/2017 | McMillion | |
| 2018/0085927 | A1 * | 3/2018 | Kapoor | A47L 9/2805 |
| 2018/0210445 | A1 | 7/2018 | Choi et al. | |
| 2018/0267552 | A1 * | 9/2018 | Artes | G05D 1/246 |
| 2019/0086921 | A1 | 3/2019 | Xia et al. | |
| 2019/0248007 | A1 * | 8/2019 | Duffy | B25J 9/1653 |
| 2021/0022578 | A1 * | 1/2021 | Koebrick | A47L 11/4036 |
| 2022/0074762 | A1 | 3/2022 | Artes et al. | |
| 2022/0168893 | A1 * | 6/2022 | Hamilton | G05D 1/0274 |

FOREIGN PATENT DOCUMENTS

| | | | | |
|---|---|---|---|---|
| DE | 102017112740 | A1 | | 12/2018 |
| DE | 102018121365 | A1 | | 4/2020 |
| JP | 2007193736 | A | * | 8/2007 |
| WO | 2021129918 | A1 | | 7/2021 |

* cited by examiner

METHOD FOR AUTONOMOUS PROCESSING OF FLOOR SURFACES

FIELD AND BACKGROUND OF THE INVENTION

The invention relates to a method for autonomous processing of floor surfaces with the aid of a mobile, self-driving device, in particular a floor cleaning device such as a suction and/or sweeping and/or mopping robot. Moreover, the invention relates to a mobile, self-driving device, with which a processing of this type can be implemented.

Mobile, self-driving devices such as for instance suction robots have the task of cleaning an entire floor surface as autonomously as possible. Obstacles lying on the floor, such as shoes, socks or toys, in particular hinder the devices in reaching every point on the floor surface. Moreover, the problem is that these obstacles are often so small that space-sensing sensors, such as for instance 360° laser sensors, are not able to detect the obstacles on account of their low height. If the device does not identify the obstacles, it may ensue that the device sucks in the obstacles and these then block the suction channel or that components of the obstacles, such as shoelaces for instance, wrap around the brush roller. It may also be that the device drives against the obstacles and as a result gets stuck. In this regard the user is not only presented with the problem of the device not being able to clean all points but also of the device no longer being able to resolve a situation and requiring help to be able to resume its task.

Conventional mobile, self-driving devices can identify different obstacles on the floor in front of them by means of a suitable sensor system, for instance by way of cameras and object recognition algorithms, and subsequently drive around them. In this way it is possible to prevent the device from crashing into the obstacles, getting stuck or sucking them in. The disadvantage here however is that the corresponding areas of the floor on which the obstacles lie are not cleaned.

Conventional mobile, self-driving devices which do not have object recognition approach inter alia the respective obstacle, touch it with a bumper for instance and then look for a detour or do not identify the obstacle, drive over it, try to suck it in or push it around the area. If the obstacle is not sucked in and the device is able to overcome the obstacle without any problem, it may be that the device distributes the obstacles across the room.

SUMMARY OF THE INVENTION

The object of the invention is to provide an effective, optimized and/or reliable method for autonomous processing of floor surfaces, with which in particular as complete a cleaning of the floor surface as possible can be ensured, by the floor surface to be cleaned preferably being cleared of movable obstacles before or during the cleaning process, wherein at the same time non-movable obstacles preferably remain at their position.

This object is achieved by a method for processing floor surfaces having the features of the independent method claim and by a mobile, self-driving device having the features of the independent mobile, self-driving device claim. Advantageous embodiments and developments are the subject matter of the subclaims.

In accordance with the invention, a method for autonomous processing of floor surfaces with the aid of a mobile, self-driving device, in particular a floor cleaning device such as a suction and/or sweeping and/or mopping robot, comprises the following method steps:

- Implementing an exploration tour of the mobile, self-driving device in a proposed floor processing area,
- Detecting obstacles and/or objects located on the floor by means of a detection facility,
- Classifying the obstacles and/or objects as movable or non-movable, and
- Transporting the obstacles and/or objects classified as movable to at least one collection point, wherein the collection point is cleaned, before obstacles and/or object classified as movable are transported to the collection point.

The inventive solution is characterized in that the mobile, self-driving device collects the movable obstacles lying in the room before or during the cleaning process and deposits the same at a central location, the collection point, where these obstacles do not interfere with the cleaning process and can be quickly found by the user. In this way the mobile, self-driving device deliberately looks for obstacles before a cleaning process, for instance, in order to bring these to the collection point and thus to clear the floor surface to be cleaned, wherein advantageously at the same time the floor surface is cleared and the obstacles are collected. In this context, the mobile, self-driving device differentiates between movable obstacles such as socks, shoes, toys for instance and non-movable obstacles such as cables, socket strips, lamp stands, chair legs, pet excrement, for instance. The mobile, self-driving device therefore classifies the obstacles lying on the floor and moves the movable obstacles to the collection point, in order to ensure as complete a cleaning of the floor surface as possible, wherein at the same time a rough type of clearing up is carried out by the mobile, self-driving device. A plurality of functions is therefore advantageously available to the user. In this process the user recovers the moved obstacles and items at a predefined location (collection point). Searching the apartment for the moved obstacles and items is advantageously not required.

A mobile, self-driving device is to be understood to mean in particular a floor cleaning device, for instance cleaning or lawn mower device, which autonomously processes floor areas or lawns in particular within the household. This includes inter alia suction and/or mopping and/or sweeping robots such as for instance robot vacuum cleaners or robot lawnmowers. During operation (cleaning operation or lawnmower operation) these devices preferably operate without user intervention or with as little user intervention as possible. For instance, the device moves automatically in a predetermined room, in order to clean the floor in accordance with a predetermined and programmed process strategy.

An exploration tour is understood to mean in particular an exploratory tour which is suited to exploring a floor surface to be processed for obstacles, room layout and suchlike. The aim of an exploration tour is in particular to be able to assess and/or represent given factors of the floor processing area to be processed.

A floor processing area is understood to mean any spatial area which is proposed for processing, in particular cleaning. This can be an individual (living) space or an entire apartment, for instance. This may also be understood to include merely areas of a (living) space or an apartment which are proposed for cleaning.

Obstacles are understood to mean any objects and/or items which are arranged in the floor processing area, for instance lie there and affect the processing by the mobile, self-driving device, in particular prevent and/or interfere with the same such as for instance furniture, walls, curtains, rugs and suchlike.

Movable obstacles are understood to mean any obstacles which can and in particular also should be moved by the mobile, self-driving device. In this regard it is therefore not only decisive that a movement is in general possible, but that a movement is also actually provided. For instance, pet excrement is basically movable. However this is not proposed since excrement would otherwise be spread out through the entire apartment. Movable obstacles are for instance toys, shoes, socks and other obstacles lying around.

Non-movable obstacles are accordingly any obstacles which cannot be moved by the mobile, self-driving device and similarly any obstacles which can be moved, but whose movement is not proposed. For instance, non-movable obstacles include socket strips, cables, lamp stands, chair legs and pet excrement.

A detection facility is understood to mean any facility which is suited to detecting obstacles particularly reliably. This is preferably sensor-based and/or camera-based.

A collection point is understood to mean any spatial, in particular three-dimensional location in or adjacent to the floor processing area. A collection point is to be understood here in particular in the spatial sense.

Classification is understood to mean in particular a subdivision of the obstacles and/or objects and/or items into movable or non-movable. In addition, further classifications can be carried out, such as for instance into different categories, for instance "socks" category, "shoes" category, "toys" category etc.

Transportation is understood to mean in particular any possibility of transportation, such as for instance reaching for the obstacles and items, retaining them, clamping them, lifting them and/or moving the obstacles and items using the mobile, self-driving device.

After the exploration tour, the mobile, self-driving device identifies its environment and can relay this in the form of a surroundings map to the user, for instance in an app on a mobile device. In the surroundings map, the user is given the option of defining an area as a collection point, to which the mobile, self-driving device is to bring the movable obstacles. Alternatively, the mobile, self-driving device itself can establish an area as a collection point. This decision can be based on the position of the location, the rapid accessibility and other properties such as for instance travel path for the user, possible tripping hazards for the user etc. The collection point is preferably shown in the surroundings map. The user can advantageously see the position of the collection point in the surroundings map and if necessary change and/or adjust the same.

A surroundings map is understood to mean in particular any map which is suited to displaying the surroundings of the floor processing area with all its obstacles. For instance, the surroundings map roughly shows the floor processing area with the obstacles and walls contained therein.

The surroundings map with the obstacles is preferably shown in the app on a portable additional device. This is used in particular to visualize a possible interaction for the user.

An additional device is at present understood to mean in particular any device which is portable for a user, which is arranged outside of the mobile, self-driving device, in particular differs from the mobile, self-driving device, and is suited to displaying, providing, transmitting and/or transferring data, such as for instance a cellphone, a smartphone, a tablet and/or computer or laptop.

The app, in particular a cleaning app, is in particular installed on the portable additional device, said cleaning app being used to communicate between the mobile, self-driving device and the additional device and in particular to visualize the floor processing area, in other words the living space to be cleaned or the apartment or living area to be cleaned. Here the app preferably shows the user the area to be cleaned as a surroundings map and any obstacles and collection points.

In an advantageous embodiment, the collection point is determined by the mobile, self-driving device itself. In particular, the position of the collection point in the apartment is determined by the mobile, self-driving device itself and is preferably shown to the user in the surroundings map. As a result, the collection point can advantageously be based on the position of the location, the rapid accessibility and other properties such as for instance the travel path of the user or preventing tripping hazards for the user. As optimal a position of the collection point as possible can advantageously be provided. The user's suggestion of the collection point can particularly preferably be seen in the surroundings map and if necessary changed or adjusted.

In a further advantageous embodiment, a route from the obstacle and/or object classified as movable to the collection point is determined by the mobile, self-driving device itself. The route from the obstacle to the collection point is therefore selected by the mobile, self-driving device itself and is not specified by the user. In this way the mobile, self-driving device can freely select the route on the basis of different criteria such as rapid accessibility, no obstacles on the route and suchlike.

In a further advantageous embodiment, a plurality of collection points is defined in particular by the mobile, self-driving device. If a number of collection points are defined, the mobile, self-driving device can advantageously bring the movable obstacles to the collection point which is currently closest to the mobile, self-driving device. Moreover or alternatively, the mobile, self-driving device can use only one collection point until it is conceivable that two collection points are required and/or it brings noticeable advantages for the processing speed.

In a further advantageous embodiment, free areas of the floor processing area are cleaned, before and/or while obstacles and/or objects classified as movable are transported to the collection point. In accordance with the invention, the collection point to which the movable obstacles are to be transported is advantageously cleaned before this collection point is no longer accessible for cleaning on account of the obstacles transported thereto. The floor area of the collection point is therefore firstly cleaned in order then to transport the movable obstacles into the cleaner floor area of the collection point which is already cleaned. As complete a cleaning of the floor processing area as possible is advantageously enabled.

The classification, collection and transportation of the movable obstacles is preferably carried out during the implementation of the cleaning program. The mobile, self-driving device continuously scans the floor area in front of it and even before physical contact identifies which items, objects or obstacles are involved, collects corresponding obstacles and brings them into the collection point proposed for this purpose in order then to continue the cleaning process.

A search tour is particularly preferably implemented by the mobile, self-driving device before actually starting the cleaning program and/or after cleaning the collection point, said search tour searching the floor area within the floor processing surface to be cleaned. Any or all identified obstacles classified as movable are brought here to the collection point. The actual cleaning of the floor processing surface is then begun.

In a further advantageous embodiment, obstacles and/or objects classified as movable are transported to the collection point, in particular before the floor processing area is cleaned. As a result, this advantageously enables an interruption-free cleaning. In particular, before actually starting the cleaning program, a so-called clear-up program is started, during which the mobile, self-driving device carries out a search tour for movable obstacles and transports these away to the collection point without executing the cleaning program. The floor cleaning can then be carried out. Alternatively, the user can start the clear-up program and allow it to run without then carrying out a floor cleaning process.

In a further advantageous embodiment, the collection point lies outside of the floor processing area. As complete a cleaning process as possible can therefore be ensured. In particular, the mobile, self-driving device brings the obstacles classified as movable to the collection point which lies outside of the floor surface to be cleaned. For instance, the collection point is located in the study when the living room is to be cleaned.

In a further advantageous embodiment, the obstacles and/or objects classified as movable are stored in a sorted manner. In particular, the obstacles classified as movable are stored classified in accordance with a successful recognition by the mobile, self-driving device. For instance, socks are placed on a first pile, shoes on a second pile and toys on a third pile at the collection point. As a result, an advanced clearing up takes place by means of the mobile, self-driving device, as a result of which the subsequent clearing away of the obstacles from the collection point by the user is advantageously facilitated.

In accordance with the invention, a mobile, self-driving device, in particular floor cleaning device for autonomously processing floor surfaces such as a suction and/or sweeping and/or mopping robot, comprises a detection facility for detecting obstacles and/or objects located on the floor, a classification facility for classifying the obstacles and/or objects as movable or non-movable, and a transport facility for transporting the obstacles and/or objects classified as movable to at least one collection point, wherein a cleaning of the collection point is provided before transportation of the obstacles and/or objects classified as movable to the collection point.

Any features, configurations, embodiments and advantages relating to the method can also be used in conjunction with the inventive mobile, self-driving device and vice versa.

As a detection facility, the mobile, self-driving device preferably comprises a suitable sensor system such as for instance a 3D camera, a PMD sensor, 3D LIDAR, a (stereo) (black, white RGB or infrared) camera, an infrared night vision camera in order to be able to guarantee implementation of the clearing up even in poor light conditions and/or a camera in combination with frontally attached LEDs, in order to illuminate the area in front of the cleaning device. The detection facility is in particular suited to identifying objects and items located on the floor and to differentiate or classify the same. Identifying any type of object is not necessarily required here. Classification into obstacles which are non-movable, which are or must remain in particular at a location and which have to be moved during the cleaning process, and into obstacles which are to or may be moved or transported away is currently adequate.

A classification facility is in particular understood to mean any facility which is suited to being able to carry out a corresponding classification of the obstacles and/or objects as movable or non-movable. A more detailed classification of the obstacles is not absolutely necessary, but can however be implemented.

The transport facility is provided and suited to transporting the obstacles and/or objects classified as movable to at least one collection point. The transport facility preferably comprises a gripping facility, a clamping facility, a wall facility and/or a scooping facility.

For instance, the mobile, self-driving device comprises a robot arm or a similar mechanism which is able to grip, clamp and/or lift objects, items and/or obstacles, and to carry away or at least deposit the same.

Alternatively, the mobile, self-driving device moves the obstacles with the transport facility over the floor. In this regard, side walls which can be folded out/extended are used, for instance, as a stabilizer against lateral slipping of the obstacles when cornering. A frontal for instance grid-type partition which can be folded out/extended in front of the mobile, self-driving device particularly preferably prevents the transported obstacles from reaching a suction mouth, a brush roller or generally below the mobile, self-driving device. Preferably, after placing the obstacles at the collection point, any side walls and the frontal partition are preferably retracted in order advantageously to reestablish a normal maneuverability of the mobile, self-driving device.

Furthermore, alternatively, a blade-type collection mechanism can be used as the transport facility, which slightly lifts the obstacles and thus also enables transportation over door thresholds and suchlike.

The invention is explained in more detail using the subsequent embodiments of the invention which only show examples. The drawings show:

DETAILED DESCRIPTION OF THE INVENTION

Figure 1:
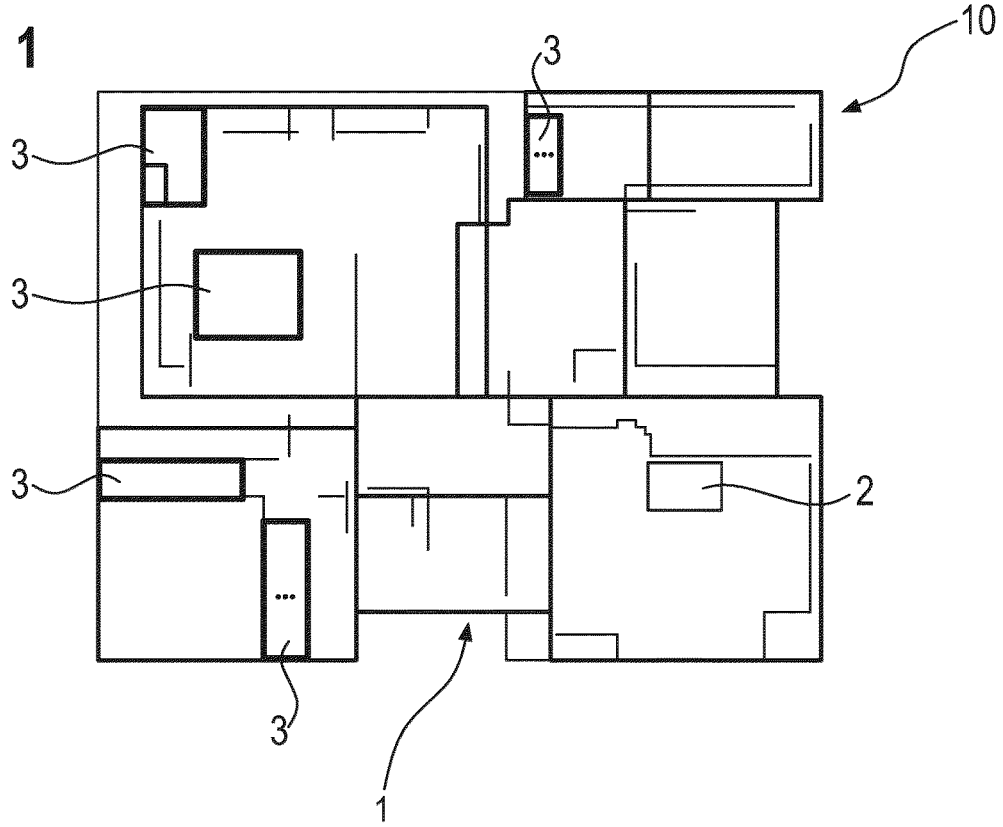
FIG. 1: a schematic view of an exemplary embodiment of a surroundings map before implementing the inventive method for automatically processing floor surfaces with the aid of a mobile, self-driving device.

FIG. 1 shows a surroundings map 10 of an apartment to be cleaned, in particular of a floor processing area 1 to be cleaned. This surroundings map is shown in an app, in particular a cleaning app, of a portable additional device, in particular a mobile device. Interaction between a user and a mobile, self-driving device, in particular a suction robot, is thus possible.

The surroundings map 10 is produced by the mobile, self-driving device. To this end, the suction robot carries out an exploration tour, during which the suction robot moves over and identifies its surroundings and forwards this to the user in the form of the surroundings map in the app of the mobile device. With the exploration tour, any obstacles, items and objects 3 located on the floor are detected by means of a detection facility, such as for instance socks, toys, shoes, rugs, walls, door thresholds etc. lying on the floor, and shown to the user in the surroundings map at the correct location. In order to detect the obstacles, items and objects, the suction robot comprises a suitable sensor system, such as, for instance, a 3D camera, 3D LIDAR, PMD sensor and/or a (stereo) camera.

In addition to detecting the obstacles, items and objects 3 located on the base, these are additionally classified by the suction robot as movable obstacles and non-movable obstacles. Identifying any type of object is not necessarily required here. The suction robot identifies in particular which obstacles are to/have to remain in their position and subsequently have to be driven around, such as for instance socket strips, cables, lamp stands, chair legs, pet excrement and suchlike and which obstacles can be moved by the suction robot and transported away, such as for instance toys, socks, shoes and other items lying around.

After classifying the obstacles, the obstacles and/or objects classified as movable are transported to a collection point 2. The collection point 2 can be predefined by the user in the surroundings map 10 for instance, to which the suction robot is to transport the loose, movable obstacles lying around. Alternatively, the suction robot can itself establish the area which it selects as the collection point 2. Here the location of the area, the rapid accessibility and other properties such as for instance a travel path for the user, tripping hazards and suchlike are taken into account. This proposal is preferably shown to the user in the surroundings map 10, so that if necessary the user can change and/or adjust the collection point 2.

Moreover, it is possible to define a number of collection points (not shown), to which the suction robot can bring the obstacles. In particular, the suction robot approaches the collection point which is closest to it. Alternatively or in addition, the suction robot only uses a first collection point until this is full and a second collection point is required or it brings noticeable advantages for the working speed.

The collection point can lie outside of the floor are to be cleaned, for instance in an office, when the living room is to be cleaned. This can ensure that the floor area to be cleaned is cleaned as thoroughly as possible.

Figure 2A:
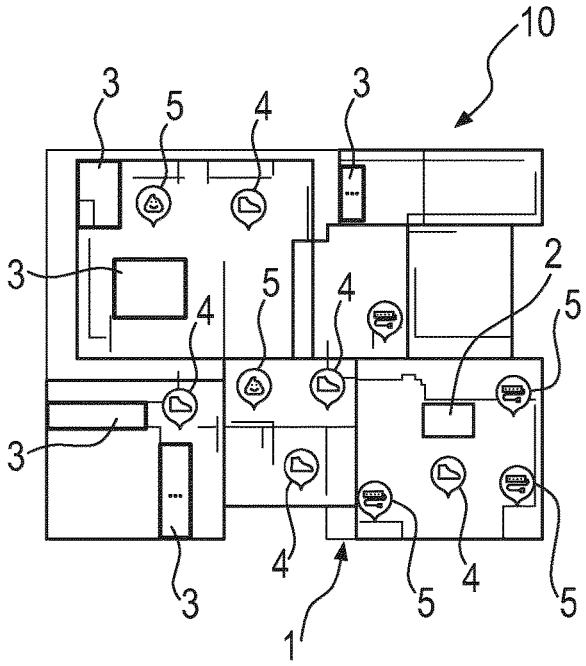
FIG. 2A: a schematic view of an exemplary embodiment of a surroundings map of a method step for implementing the inventive method for automatically processing floor surfaces with the aid of a mobile, self-driving device

FIG. 2A shows a surroundings map 10, in which a plurality of obstacles, items and objects 3 are specified. Moreover, movable obstacles 4 and non-movable obstacles 5 are shown, which have been detected by the suction robot during the exploration tour and classified.

Figure 2B:
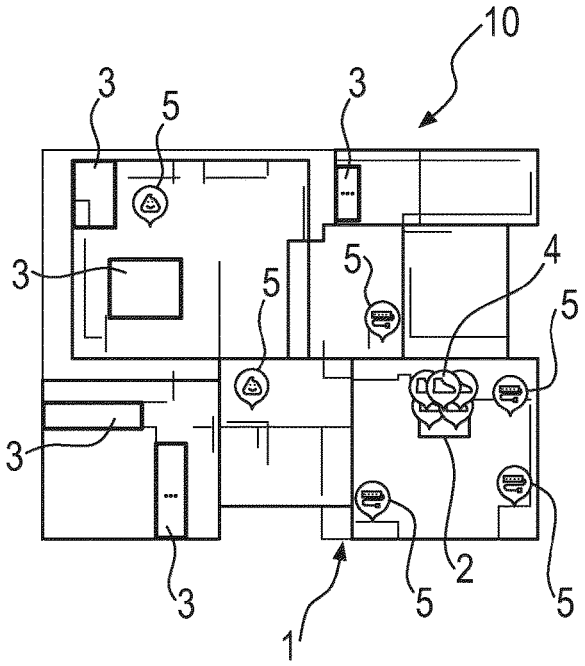
FIG. 2B: a schematic view of an exemplary embodiment of a surroundings map of a further method step for implementing the inventive method for automatically processing floor surfaces with the aid of a mobile, self-driving device.

Before the suction robot now transports the obstacles classified as movable to the collection point, it cleans the collection point in order to be able to ensure that the collection point is also cleaned, which is no longer possible after transporting the items. The collecting and taking away of the movable obstacles 4 during the implementation of the cleaning program is then preferably carried out. In this process the suction robot continuously scans the floor area in front of it and even before physical contact identifies what the obstacles are, collects correspondingly movable obstacles 4 and brings them to the collection point 2 and then continues its cleaning. At the end of the cleaning program, all obstacles 4 classified as movable are located at the collection point 2, while the obstacles 5 classified as non-movable continue to remain at their location, as shown in FIG. 2B.

Alternatively, it is possible that before actually starting the cleaning program and after cleaning the collection point 2, a search tour is carried out by the suction robot which searches the floor of the floor processing area to be cleaned. Identified obstacles are brought to the collection point 2. The actual cleaning is then begun.

Further alternatively or in addition, it is possible to offer the user a clear-up program which the user can start via the app without allowing a subsequent floor cleaning process to ensue.

Identified movable obstacles 4 are preferably stored classified at the collection point 2. For instance, socks are placed on a first pile at the collection point 2, shoes on a second pile at the collection point 2 and toys on a third pile at the collection point 2. This advantageously facilitates subsequent clearing up by the user.

To ensure that the suction robot is able to collect the obstacles, it preferably comprises a robot arm or a similar mechanism, which allows gripping, clamping, lifting, carrying away and/or storing. Alternatively or in addition, side walls which can be folded out/extended are used, which permit the obstacles to slide over the floor and prevent a lateral slipping of the obstacles during cornering. A preferred grid-type partition which can be folded out/extended in front of the robot prevents obstacles from reaching the suction mouth, the brush roller or below the suction robot. Once the obstacles are placed at the collection point 2, the side walls and the front partition are retracted again in order to simplify maneuvering of the suction robot. Further additionally or alternatively, a blade-type collection mechanism can be used, which lifts the obstacles and thus enables transportation also over door thresholds.

With the method according to the invention, the obstacles 3, 4, 5 lying on the floor are identified, classified and the movable obstacles 4 brought to the collection point 2, in order to be able to clean the floor area to be cleaned as completely as possible and at the same time to carry out a rough type of clearing up. Non-movable obstacles 5 remain at the location and position.

The invention claimed is:

1. A method for autonomous processing of floor surfaces with an aid of a mobile, self-driving device, the method comprises the following steps of:

implementing an exploration tour by the mobile, self-driving device in a proposed floor processing area;

detecting obstacles and/or objects disposed on the proposed floor processing area by means of a detection facility;

classifying the obstacles and/or the objects as movable or non-movable; and defining a plurality of collection points with the mobile, self-driving device;

transporting the obstacles and/or the objects classified as movable to at least one of the plurality of collection points, the at least one collection point being cleaned before the obstacles and/or the objects classified as movable are transported to the at least one collection point, the at least one collection point being determined via the mobile, self-driving device itself and based on a position of a location of the at least one collection point, a rapid accessibility of the location of the at least one collection point, a travel path of a user to the location of the at least one collection point and/or preventing tripping hazards for the user going to the at least one collection point; and configuring the mobile, self-driving device to bring the movable obstacles to one of the plurality of collection points closest to the mobile, self-driving device and the mobile, and the self-driving device being configured to use only one of the plurality of collection points until the one of the plurality of collection points is full and another of the plurality of collection points is required and/or there are noticeable advantages for the processing speed brought about.

2. The method according to claim 1, which further comprises determining a route from the obstacle and/or the object classified as movable to the at least one collection point by the mobile, self-driving device itself.

3. The method according to claim 1, which further comprises cleaning free areas of the proposed floor processing area, before and/or while the obstacles and/or the objects classified as movable are transported to the at least one collection point.

4. The method according to claim 1, which further comprises transporting the obstacles and/or the objects classified as movable to the at least one collection point.

5. The method according to claim 1, wherein the at least one collection point lies outside of the proposed floor processing area.

6. The method according to claim 1, which further comprises storing the obstacles and/or the objects classified as movable in a sorted fashion.

7. The method according to claim 1, wherein the mobile, self-driving device is a floor cleaning device or a suction and/or a sweeping and/or a mopping robot.

8. The method according to claim 1, which further comprises transporting the obstacles and/or the objects classified as movable to the at least one collection point before the proposed floor processing area is cleaned.

9. A mobile, self-driving device, comprising:

a detector for detecting obstacles and/or objects disposed on a floor;

the mobile, self-driving device being configured for defining a plurality of collection points;

a classification facility for classifying the obstacles and/or the objects as movable or non-movable; and a transporter for transporting the obstacles and/or the objects classified as movable to at least one of the plurality of collection points, wherein the at least one collection point is cleaned before transporting the obstacles and/or the objects classified as movable to the at least one collection point, the at least one collection point being determined via the mobile, self-driving device itself and based on a position of a location of the at least one collection point, a rapid accessibility of the location of the at least one collection point, a travel path of a user to the location of the at least one collection point and/or preventing tripping hazards for the user going to the at least one collection point; and the mobile, self-driving device being configured to bring the movable obstacles to one of the plurality of collection points closest to the mobile, self-driving device and the mobile, and the self-driving device being configured to use only one of the plurality of collection points until the one of the plurality of collection points is full and another of the plurality of collection points is required and/or there are noticeable advantages for the processing speed brought about.

10. The mobile, self-driving device according to claim 9, wherein said transporter has a gripping facility, a clamping facility, a wall facility and/or a scooper facility.

11. The mobile, self-driving device according to claim 9, wherein the mobile, self-driving device is a floor cleaning device for autonomous processing of floor areas.

12. The mobile, self-driving device according to claim 9, wherein the floor cleaning device for autonomous processing of the floor areas is a suction and/or a sweeping and/or a mopping robot.

* * * * *